United States Patent [19]

Matsuda et al.

[11] Patent Number: 4,555,921

[45] Date of Patent: Dec. 3, 1985

[54] METHOD AND APPARATUS FOR CONTROLLING WIDTH AND THICKNESS OF STRIP

[75] Inventors: Yukio Matsuda; Kenzo Tachibana, both of Ibaraki; Tsutomu Ueno, Chiba, all of Japan

[73] Assignee: Sumitomo Metal Industries, Ltd., Osaka, Japan

[21] Appl. No.: 625,691

[22] Filed: Jun. 28, 1984

Related U.S. Application Data

[62] Division of Ser. No. 458,942, Jan. 18, 1983, abandoned.

[30] Foreign Application Priority Data

Mar. 2, 1982 [JP] Japan ..... 57-32625
Apr. 22, 1982 [JP] Japan ..... 57-68008

[51] Int. Cl.[4] ..... B21B 13/08
[52] U.S. Cl. ..... 72/224; 72/234; 72/366
[58] Field of Search ..... 72/199, 366, 234, 224, 72/225

[56] References Cited

U.S. PATENT DOCUMENTS

| | | | |
|---|---|---|---|
| 3,757,556 | 9/1973 | Kawawa et al. | 72/234 |
| 4,033,165 | 7/1977 | Aimura et al. | 72/234 |
| 4,386,511 | 6/1983 | Morita | 72/366 |

FOREIGN PATENT DOCUMENTS

| | | | |
|---|---|---|---|
| 139864 | 10/1979 | Japan | 72/234 |
| 139101 | 10/1980 | Japan | 72/234 |
| 111510 | 9/1981 | Japan | 72/234 |
| 2063742 | 6/1981 | United Kingdom | 72/234 |

*Primary Examiner*—Leonidas Vlachos
*Assistant Examiner*—Jerry Kearns
*Attorney, Agent, or Firm*—Burns, Doane, Swecker and Mathis

[57] ABSTRACT

Width and thickness of a hot-rolled and descaled strip are controlled by performing, in a line in which the strip runs, a rough control step for reducing correction of the width and the thickness of the strip in only the longitudinal ends thereof and a fine control step for reducing correction of the width and the thickness of the strip over the entire length thereof, respectively at least one time, so that the desired width and thickness of the strip are obtained in the last reduction.

4 Claims, 19 Drawing Figures

Fig. 1
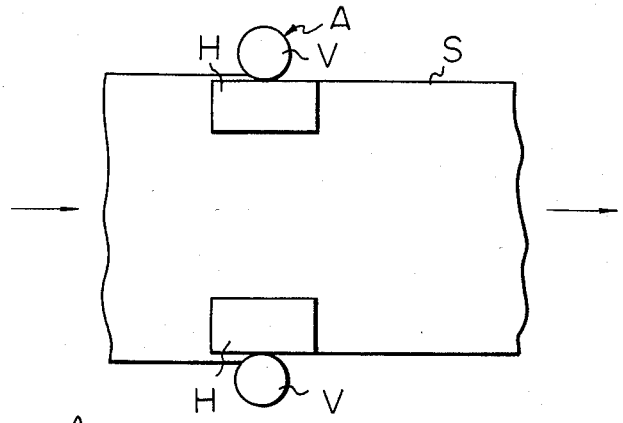
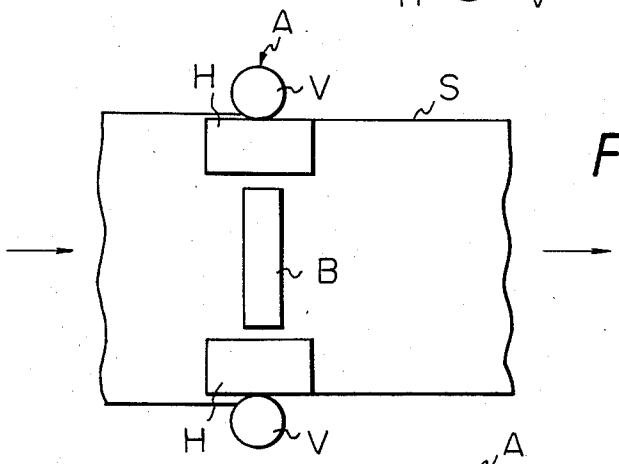
Fig. 2
Fig. 3
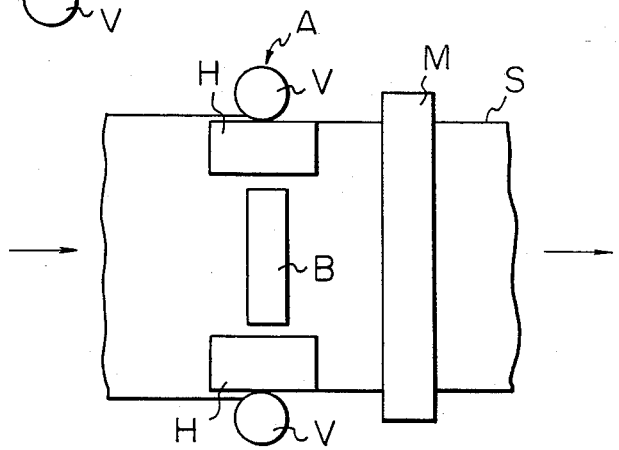

METHOD AND APPARATUS FOR CONTROLLING WIDTH AND THICKNESS OF STRIP

This application is a division of application Ser. No. 458,942, filed Jan. 18, 1983, now abandoned.

BACKGROUND OF THE INVENTION

The present invention relates to a method and an apparatus for controlling uniformly the width and the thickness of a descaled strip.

In a strip rolling process, edge drop (a thin portion) is unavoidably produced in widthwise edge portions of the strip. Accordingly, side trimming by rotary shearing is generally performed as an only means for removing the edge drop and to secure the desired dimensional accuracy in the width of the strip. However, this conventional side trimming had disadvantages such that a 1 to 2% loss in yield rate was usually unavoidable because the strip was cut away and discarded from both the edges to the depth of several millimeters to several tens millimeters and that the product after cold rolling became saw-toothed shape in the edges according to the shape of the sheared faces thereof, to thereby decrease the quality of the product.

As a means for overcoming the above-mentioned disadvantages, the inventors have developed a means for obtaining a strip of a desired thickness without performing side trimming by shearing, in which a descaled strip is corrected by reduction simultaneously in the widthwise and the thicknesswise directions on the exit side of a pickling line or on the entrance side of a tandem cold rolling mill (Japanese Patent Public Disclosure No. 160501/1982).

In the above-identified method, a strip which has edge drops on both the edge portions thereof and is not uniform in the width is corrected first by vertical rolls to define the width. At this time, the strip is somewhat bulged in edge portions thereof by reduction and tends to become dog-bone shape while, at the same time, horizontal rolls hold the strip to prevent its bending and shaking and urge the bulges in the edge portions toward the central portion to make the entire width of the strip uniform.

Further in said method, in order to prevent the width of the strip corrected at the time of defining the width from being affected at the time of vertical reduction, the reduction to correct the width of the strip and the reduction to correct the thickness thereof are performed at the same position or at slightly shifted positions approximately simultaneously. When a large amount of correction of the width or the thickness of the strip is requried, the step for said correction by reduction is provided at a plurality of successive positions to take suitable parts of the amount of correction, respectively, so that the strip corrected at the last position has the desired width or thickness.

The above-described control means in rolling is very effective in increasing the accuracy of the strip width without causing trimming loss. And, an inspection of the width of the strip rolled by this method shows that the width of the strip is controlled to the desired value over the substantially entire length thereof.

Increase in reduction during cold rolling of a strip tends to produce widthwise cracks in the edge portions of the strip. In order to prevent such cracks, accordingly, a shape correcting apparatus for processing particularly the edge portions of the strip during cold rolling was proposed (Japanese Patent Public Disclosure No. 109104/1981). In this apparatus, a pair of horizontal rolls spaced from each other in parallel and a vertical roll disposed in slight contact with the end faces of the horizontal rolls cooperate to define a caliber to thereby correct the shape of the edge portions of the strip. Said shape correcting apparatus is of such construction that the axes of the horizontal rolls are slightly inclined with respect to the widthwise direction of the strip (that is, the direction perpendicular to the direction of movement of the strip) so that the edge portions of the strip are squeezed into said caliber by the frictional force of the horizontal rolls.

The above-mentioned apparatus has, however, disadvantages such that the rolls are worn unduly by abrasion between the strip and the rolls and that the side face of the strip becomes out of flatness because metal flow caused in the direction of advancement of the strip according as the change in the sectional area of the strip produces bulging in the side face of the strip.

An object of the present invention is to provide a method and an apparatus for controlling reliably the width and the thickness of a strip.

Another object of the present invention is to provide a method and apparatus for controlling steadily the width and the thickness of a strip over the entire length including the top and the bottom thereof.

SUMMARY OF THE INVENTION

A method for controlling width and thickness of a strip according to the present invention is characterized by performing, in a line in which a hot-rolled and descaled strip runs, a rough control step for reducing correction of the width and the thickness of the strip in only the longitudinal ends thereof and a fine control step for reducing correction of the width and the thickness of the strip over the entire length thereof, respectively at least one time, so as to obtain the desired width and thickness in the last reduction.

In the fine control step, firstly a pair of vertical rolls are disposed on the opposite widthwise sides, respectively, of the strip and two pairs of horizontal rolls are disposed on the upper and the lower surfaces of the opposite edge portions, respectively, of the strip so as to correct the width and the thickness of the strip simultaneously by reduction, and then the thickness of the strip is further corrected by reduction by a plurality of pieces of masher rolls disposed in the widthwise direction on the upper and the lower surfaces of the strip.

In correction of the width and the thickness of the strip by reduction, the strip is preferably prevented from widthwise buckling by back-up rolls disposed on the upper and the lower surfaces of the strip and extending in the widthwise direction thereof.

An ordinary cylindrical roll or a roll having a taper of a predetermined shape on the roll surface in engagement with the edge portion of the strip is used as the horizontal roll.

As the masher roll, an ordinary cylindrical roll extending widthwise of the strip or a roll having a taper in engagement with the edge portions of the strip and gradually decreased in diameter of the roll toward the center in width of the strip is used.

An apparatus for controlling width and thickness of a strip according to the present invention is constructed, in a line in which a hot-rolled and descaled strip runs, by disposing a basic roll unit comprising a pair of vertical rolls and two pairs of horizontal rolls and a plurality of pieces of masher rolls in a rough control station and disposing a plurality of said basic roll units and a plurality of pieces of masher rolls in a fine control station.

The basic roll unit comprises a bed, a pair of supports slidable on said bed widthwise of a strip, a pair of horizontal rolls mounted rotatably on said supports, a drive means for moving one of said horizontal rolls vertically, a vertical roll mounted rotatably on said support, and a drive means for moving said supports horizontally.

BRIEF DESCRIPTION OF THE DRAWINGS

The present invention will be better understood from the following description taken in connection with the accompanying drawings in which:

FIG. 1 is a plan view of a basic roll unit used in the method according to the present invention;

FIG. 2 is a plan view of a modification of the basic roll unit shown in FIG. 1;

FIG. 3 is a plan view of a combination of the basic roll unit shown in FIG. 2 and masher rolls;

DESCRIPTION OF THE PREFERRED EMBODIMENTS

A basic roll unit A for use in the method according to the present invention comprises, as shown in FIG. 1, a pair of vertical rolls V and two pairs of horizontal rolls H. The vertical rolls V are disposed in pair in abutment under pressure with side edges of a strip S and the horizontal rolls are disposed in two pairs which are in abutment under pressure with the upper and the lower surfaces, respectively, of the strip S at the positions adjacent to the positions whereat the vertical rolls V are in abutment under pressure with the strip S. The basic roll unit A reduces the width and the thickness of the strip S simultaneously.

The basic roll unit A may, as necessary, include backup rolls B extending widthwise of the strip S and in contact with the upper and the lower surfaces of the strip S between the horizontal rolls H as shown in FIG 2.

In order to correct the edge portions of the strip S thickened by the vertical rolls V of the basic roll unit A, masher rolls M are disposed downstream of the basic roll unit A as shown in FIG. 3.

Figure 4A:
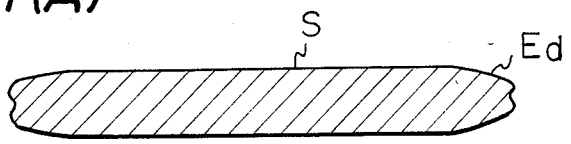
FIGS. 4(A) to 4(C) are plan views of various steps of the method according to the present invention.
Figure 4B:
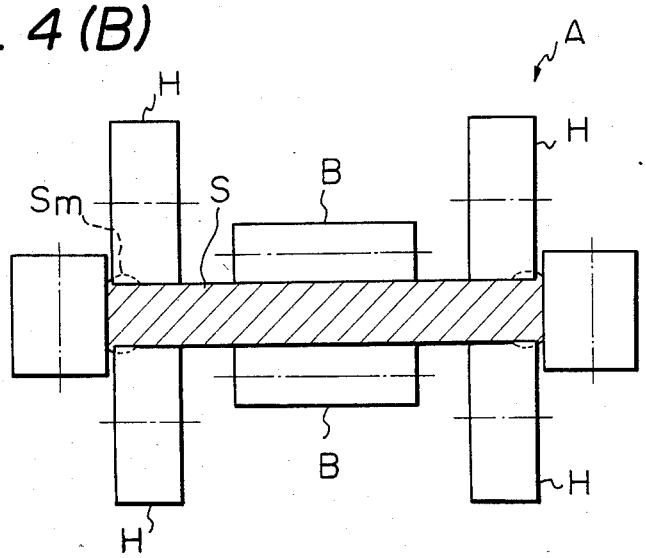

In the method according to the present invention, the strip S of the unequal width and with edge drops Ed in both the edge portions as shown in FIG. 4(A) is reduced in width and thickness simultaneously by two pairs of horizontal rolls H and a pair of vertical rolls V as shown in FIG. 4(B), to thereby shape the width and the thickness of the strip S. At this time, the back-up rolls B may be provided, as required, to hold the strip S in the upper and the lower surfaces thereof.

Figure 4C:
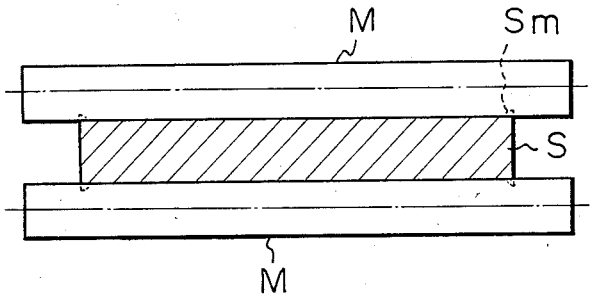

If thickened portions Sm remain uncorrected in the edge portions of the shaped strip S, the thickened portions Sm are corrected by reduction by the masher rolls M as shown in FIG. 4(C).

Figure 5:
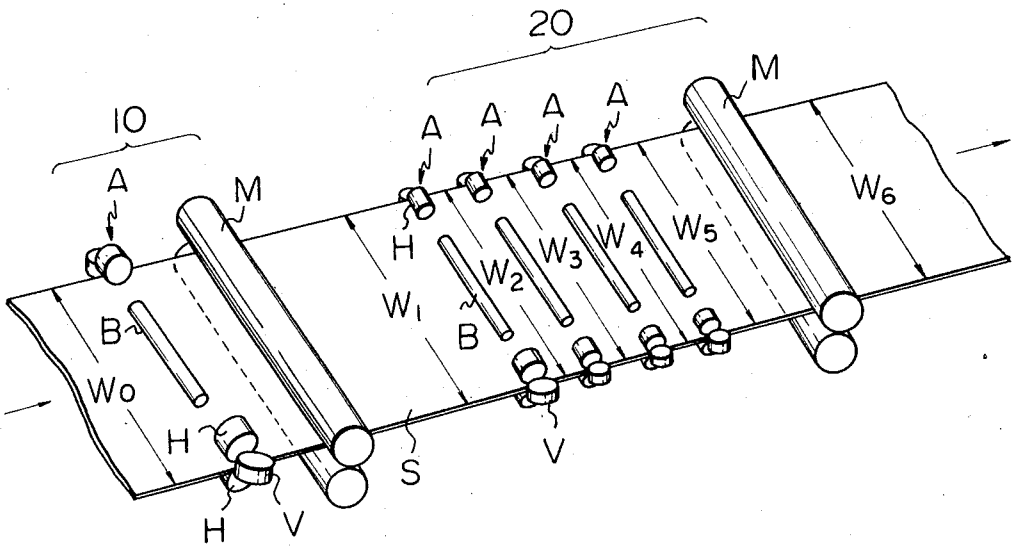
FIG. 5 is a perspective view of an embodiment of the apparatus according to the present invention.

If the dimensional accuracy of the strip S is unduly low in the top and/or the bottom, such portions must be roughly shaped first. In the method accoridng to the present invention, therefore, the basic roll units A having the construction, for example, as shown in FIG. 2 and the masher rolls M are disposed on the rolling line as shown in FIG. 5, in which one basic roll unit A and a pair of the masher rolls M are disposed on the upstream side to constitute a rough control station 10, and a plurality of basic roll units A and at least a pair of the masher rolls M are disposed on the downstream side to constitute a fine control station 20. The width of the strip S is reduced gradually from $W_0$ to $W_6$.

In the method according to the present invention, the desired values of the width and the thickness of the strip are set in the last basic roll unit A of the fine control station 20 and then the strip S is rolled in the width and the thickness simultaneously. The fine control station 20 is always operated during rolling of the entire length of the strip S. However, the rough control station 10 is not used for rolling of the intermediate portion of the strip S, but is used selectively for rolling only the top and the bottom of the strip S. That is, the top and the bottom of the strip S are rolled by both the rough control station 10 and the fine control station 20.

In the case where an extremely wide portion is produced in any of the top or the bottom of the strip S, such extremely wide portion is preferably removed by side trimming using a rotary shear or any other suitable means before the method according to the present invention is applied thereto.

A concrete construction of the basic roll unit A will now be described with reference to FIG. 6. In this construction, the basic roll unit A is disposed on each of the edge portions of the running strip S. Since the basic roll unit A is symmetrical in construction, only one side thereof will be illustrated (the right side in FIG. 6) and described. In the basic roll unit A, a pair of supports 11 are mounted on a bed 1 so as to slidably move thereon widthwise of the strip S, the vertical rolls V are attached rotatably to the supports 11 in opposition to each other on the side edges of the strip S, and a pair of the horizontal rolls H are attached rotatably to each support in opposition to each other on the upper and the lower surfaces of the edge portions of the strip S. On each side edge of the strip S, the three rolls are so assembled as to abut under pressure to the strip from the three directions, namely from above, below and side, along the same widthwise line of the strip S.

The upper horizontal roll H is vertically movably and reduction-adjustably supported by a fluid pressure cylinder 21 fixed at the top of the support 11. Rotation of a driving motor 22 is transmitted to the horizontal roll H through a universal joint. The lower horizontal roll H is an idle roll whose bearing is fixed to the support 11. Likewise, the vertical roll V is an idle roll. The support 11 having these rolls incorporated therein is urged by a fluid pressure cylinder 2 toward the edge of the strip S so as to enable the vertical roll V to perform the desired reduction.

The back-up rolls B are disposed horizontally and widthwise of the strip S between the supports 11 provided in pair, as idle rolls to hold the upper and the lower surfaces of the strip S.

Figure 7A:
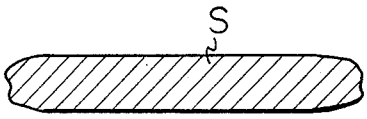
FIGS. 7(A) to 7(C) are plan views similar to FIGS. 4(A) to 4(C), showing various steps of the method according to the present invention, using modified rolls.
Figure 7B:
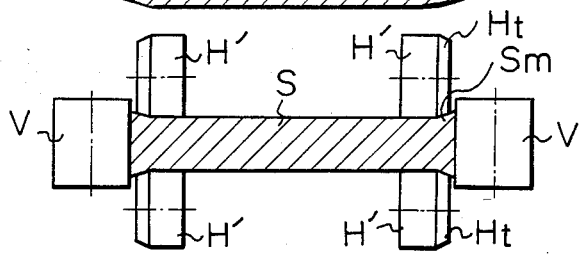
Figure 7C:
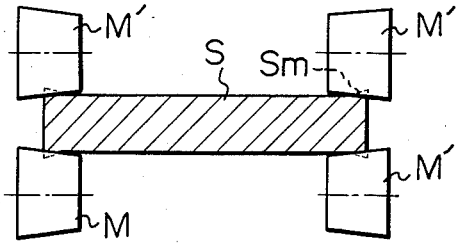

In place of the horizontal rolls H and the masher rolls M described above, horizontal rolls H' and masher rolls M' shown in FIGS. 7(B) and 7(C) may be used. The steps shown in FIGS. 7(A) to 7(C) correspond to the steps shown in FIGS. 4(A) to 4(C), respectively.

In the step for simultaneous reduction and shaping of the width and the thickness of the strip as shown in FIG. 7(B), the vertical rolls V are ordinary straight cylindrical rolls and the horizontal rolls H' are those formed with a taper $H_t$ in a portion of the roll surface in engagement with the edge portion of the strip. Accordingly, in the process of shaping reduction by these horizontal rolls H' a flow of excess metal in a predetermined direction is generated in the edge portions of the strip S by the simultaneous reduction by the vertical rolls V and the upper and the lower horizontal rolls H' and formed by the tapers $H_t$ of the horizontal rolls H' into the thickened portions Sm of the shape thickened toward the outside as shown in FIG. 7(B).

The thickened portions Sm are crushed by the masher rolls M' disposed in the immediately successive stage thereto and corrected into the predetermined thickness. In the method according to the present invention, as shown in FIG. 7(C), the masher rolls M' are slightly tapered over the entire length thereof toward the center in the width of the strip S, whereby the crushing of the thickened portions Sm and the metal flowing in the thickened portions Sm are carried out effectively.

Figure 8:
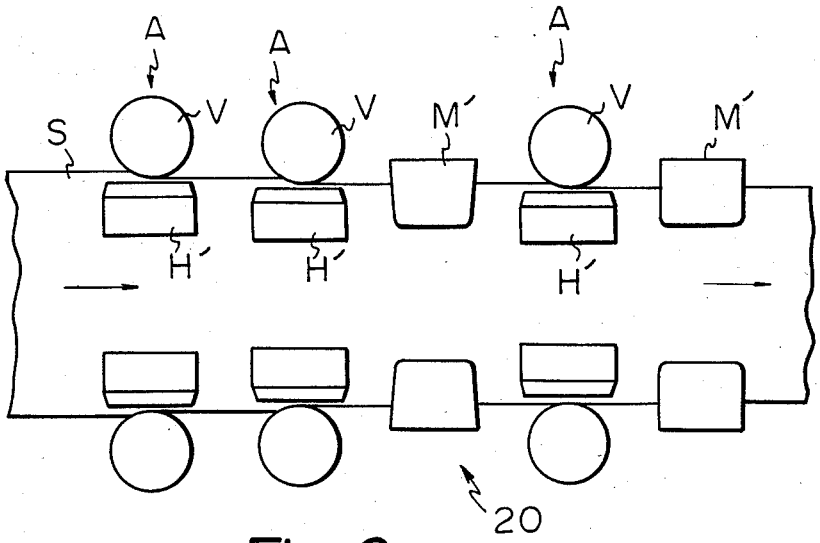
FIG. 8 is a plan view of a modification of a fine control station of the apparatus shown in FIG. 5.
Figure 9:
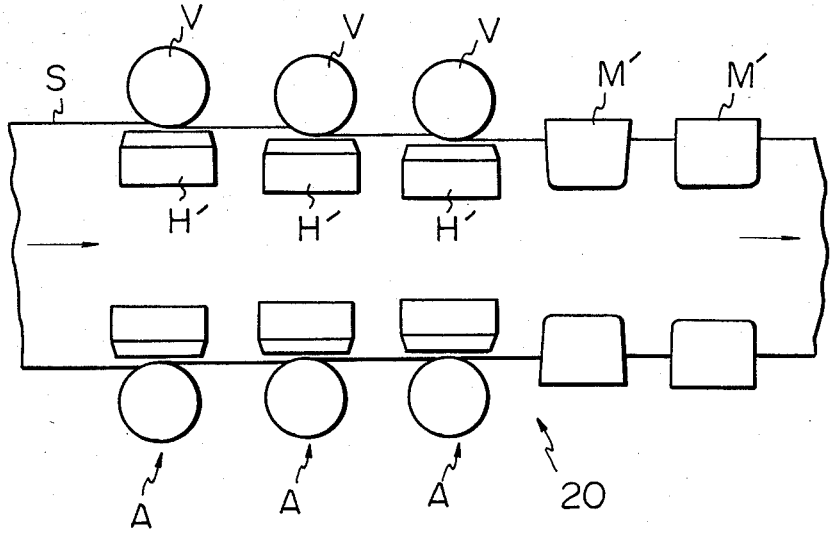
FIG. 9 is a plan view of another modification of the fine control station shown in FIG. 8.

In the fine control step of the method according to the present invention, at least one set of the reducing shaping step by the horizontal roll H' and the vertical roll V and the reducing correction step by the masher roll M', respectively, are disposed on both the widthwise collinear line of the transfer line of the descaled hot-rolled strip at the temperature of 100° C. or below, preferably to perform the reducing shaping and the reducing correction alternately as shown in FIG. 8. In this case, taperless rolls may be used as the masher rolls M' in the later stage. Alternatively, the reducing shaping steps and the reducing correcting steps may be disposed collectively in the earlier and the later stages, respectively, as shown in FIG. 9.

Figure 10:
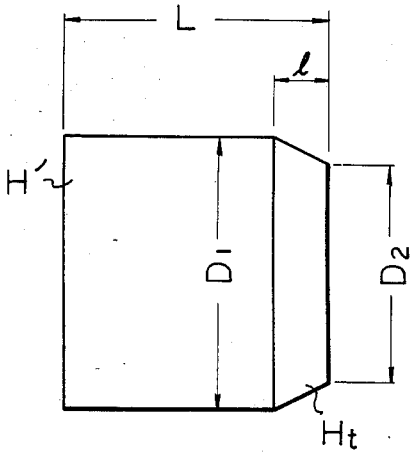
FIG. 10 is a plan view showing the dimension of a modification of a horizontal roll.

The numerical standard of the horizontal rolls H' used in the method according to the present invention is, as shown in FIG. 10, suitably to be in the ranges: $D_2/D_1=0.900-0.995$, and $l/L=0.7-0.9$ where $D_1$: maximum diameter of horizontal roll $D_2$: minimum diameter of horizontal roll L: length of barrel of horizontal roll l: length of tapered portion of horizontal roll.

Figure 6:
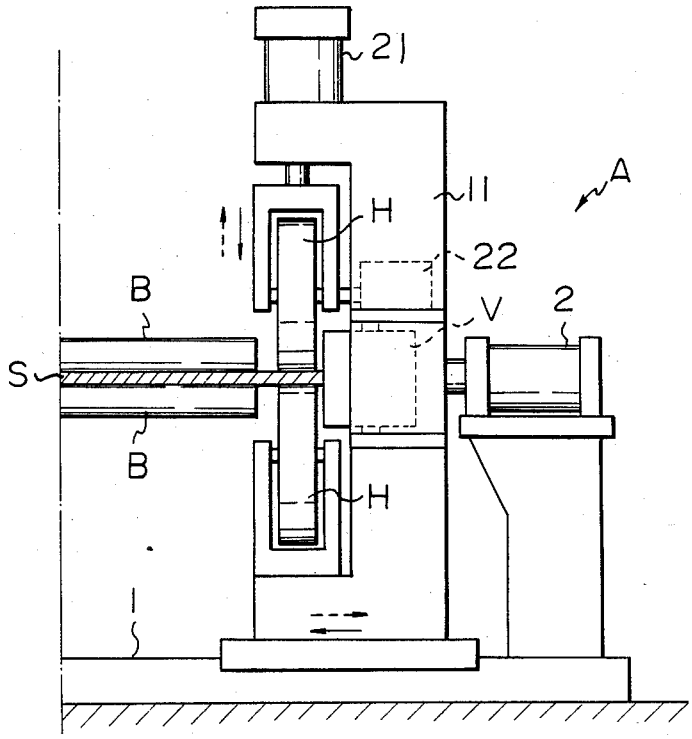
FIG. 6 is a front view showing the concrete construction of the basic roll unit shown in FIG. 2.
Figure 11:
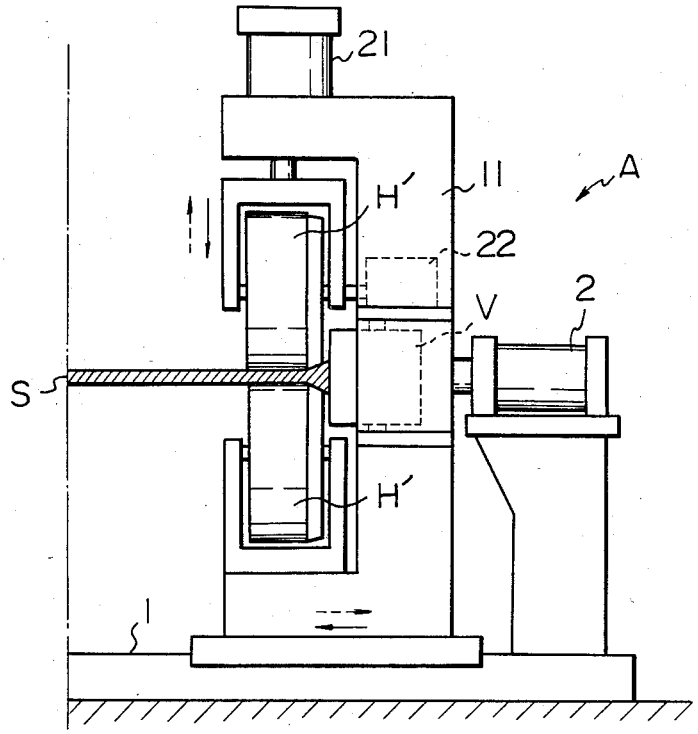
FIG. 11 is a front view similar to FIG. 6, showing the state in which the modified horizontal roll is supported.

An example of the concrete construction of the basic roll unit A comprising the horizontal rolls H' and the vertical rolls V is shown in FIG. 11, which is a similar view to FIG. 6. Throughout FIGS. 6 and 11, like reference numerals or characters denote like component parts.

Figure 12:
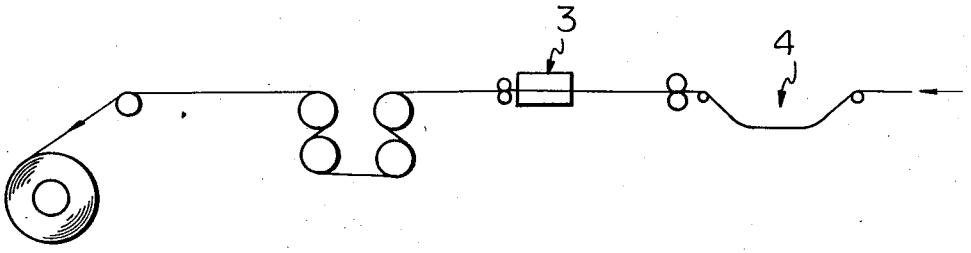
FIGS. 12(A) and 12(B) are schematic illustrations of examples of application of the apparatus according to the present invention.
Figure 12:
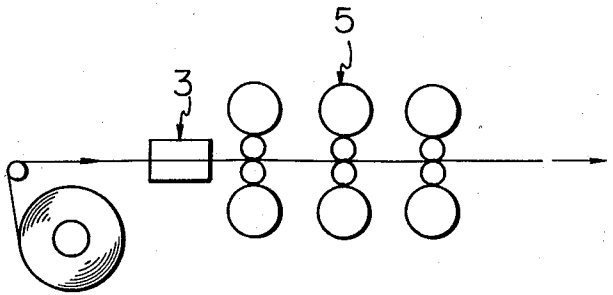

Examples of use of the apparatus 3 according to the present invention are shown in FIGS. 12(A) and 12(B). In the example of FIG. 12(A), the apparatus 3 is disposed next to a pickling bath 4, and the strip is coiled after correcting reduction. In the example of FIG. 12(B), the apparatus 3 is disposed on the entrance side of a cold rolling mill 5, and the strip is cold rolled after correcting reduction. In any of these examples, edge drops of the strip are removed and crown of the strip is reduced to satisfy the dimensional accuracy in width fully.

Examples of practice of the method according to the present invention will now be described.

EXAMPLE I

A descaled and pickled hot-rolled strip (thickness 3.0 mm×width 1005 mm×weight 20 tons) of strip width deviation of ±5 mm and strip crown of 90μ was passed through a line in which the apparatus according to the present invention was incorporated, to reduce the strip in the thicknesswise and in the widthwise directions into the uniform strip width of 990 mm. In this case, the theretofore discarded trimming allowance of 10 mm was used as product, that is, a 1.5% increase was observed in the trimming yield rate. Further, the strip crown, that is the difference in thickness of the strip between the central portion thereof and the position 10 mm inward from an edge, was reduced to 45μ. When this strip was finished by a cold tandem mill and cold rolled at the thickness of 1.0 mm, the strip crown was 15μ. In this case, since the crown of the strip which was cold rolled without passing through the apparatus according to the present invention was 30μ, the strip crown was reduced by 15μ by the use of the apparatus according to the present invention.

Figure 13:
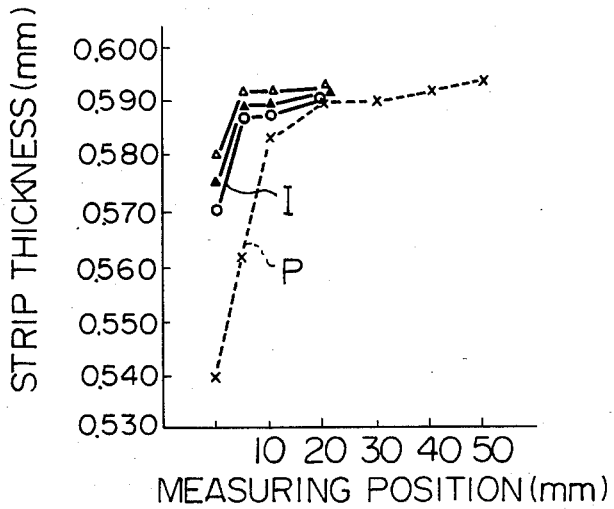
FIG. 13 is a graph showing the effect of reducing edge drop of the strip by the method according to the present invention.
Figure 14:
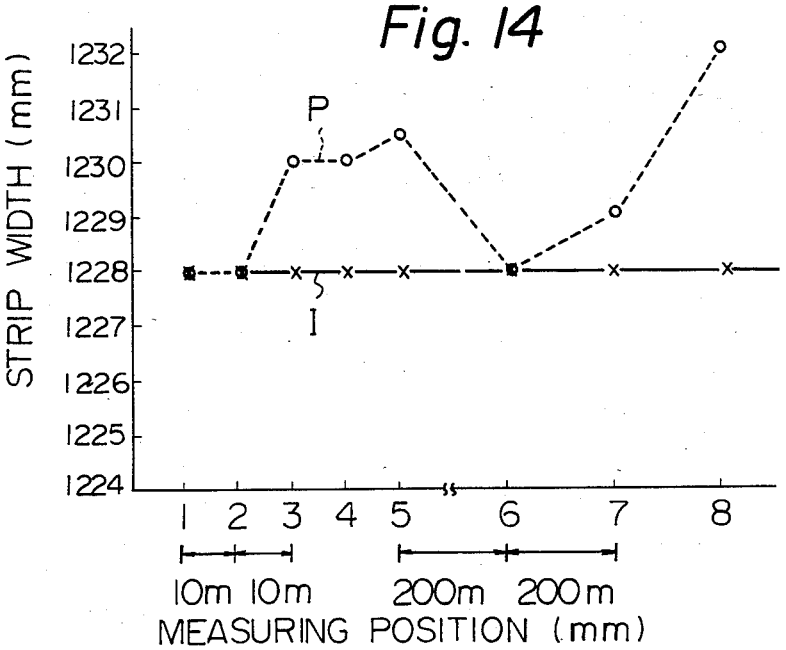
FIG. 14 is a graph showing the effect of controlling the width of the strip by the method according to the present invention.

FIG. 13 is a diagrammatical illustration showing the edge drop reducing effect (cold rolling) in which the method of the present invention I and the conventional method (starting material) P were compared. FIG. 14 is a diagrammatical illustration showing the width control effect after cold rolling, in which the reference characters I and P denote the same as in FIG. 13.

EXAMPLE II

A descaled and pickled hot-rolled strip (thickness 3.0 mm×width 1236 mm×weight 25 tons) of strip width deviation of ±3 mm and strip crown of 60μ was passed through a line in which the apparatus according to the present invention was incorporated, to reduce the strip in the thicknesswise and the widthwise directions into the uniform strip width of 1232 mm. In this case, the theretofore discarded trimming allowance of 14 mm was used as product, that is, a 1.1% increase was observed in the trimming yield rate.

Further, the edge drop after cold rolling was reduced by 9μ as compared with that in the conventional method. Therefore, a thickening allowance of 9μ was made unnecessary and a further 0.9% increase in the yield rate was achieved.

In the controlling method and apparatus according to the present invention, as described hereinabove, since the strip is corrected by reduction simultaneously in the widthwise and the thicknesswise directions into uniforms values over the entire length of the strip including the top and the bottom, trimming losses can be avoided and the dimensional accuracy in width can be still more increased. Accordingly, the method and the apparatus according to the present invention are considerably effective in increasing the yield rate of the product.

While we have described and illustrated certain preferred embodiments and examples of practice of the invention, it is to be distinctly understood that these embodiments and examples are merely for the purpose of illustration and description and that various other forms may be devised within the scope of the invention, as defined in the appended claims.

What is claimed is:

1. An apparatus for controlling width and thickness of a strip, the strip being hot-rolled and descaled and running in a line, comprising:

a rough control station for controlling dimensional accuracy of upper and lower surfaces of the strip, said rough control station including, a first basic roll unit consisting of a pair of vertical rolls which contact side edges of the strip under pressure and two pairs of horizontal rolls which contact the upper and lower surfaces under pressure at a postion adjacent said vertical rolls contact with the strip, said horizontal rolls having a taper of predetermined shape on the roll surface toward the side edge of the strip, and a pair of first masher rolls which contact the entire width of the strip downstream of said basic roll unit under pressure; and a fine control station for controlling the entire length of the strip on the downstream side of said rough control station, said fine control station including, a plurality of sets of second basic roll units which are identical to the first basic roll unit, and a plurality of pairs of second horizontal masher rolls which contact the upper and lower surfaces of the edge portions of the strip under pressure and have a taper inwardly toward the center line of the strip.

2. An apparatus according to claim 1, wherein said basic roll unit comprises:

a bed;

a pair of supports slidable on said bed widthwise of the strip;

a pair of horizontal rolls rotatably attached on each of said supports, said horizontal rolls having a taper of predetermined shape on the roll surface toward the edge side of the strip;

a first drive means for moving one of said horizontal rolls vertically;

a vertical roll rotatably attached on each side of said supports on a plane which includes axes of said horizontal rolls; and a second drive means for moving said supports horizontally.

3. An apparatus according to claim 1, wherein a set of said second basic roll units alternates with two pairs of said second masher rolls in said fine control station.

4. An apparatus according to claim 1, wherein all pairs of said second masher rolls are disposed on the downstream side of all sets of said second basic roll units in said fine control station.

* * * * *